United States Patent [19]

Tuson

[11] 4,139,322

[45] Feb. 13, 1979

[54] EQUIPMENT FOR REMOVING AND REFITTING RESILIENT PACKING IN A CARDAN JOINT

[75] Inventor: Samuel Tuson, Mesnil-le-Roi, France

[73] Assignee: Entreprise d'Equipments Mecaniques et Hydrauliques E.M.H., Boulogne, France

[21] Appl. No.: 803,855

[22] Filed: Jun. 6, 1977

[30] Foreign Application Priority Data

Jun. 11, 1976 [FR] France ..... 76-17779

[51] Int. Cl.[2] ..... F16L 1/00

[52] U.S. Cl. ..... 405/169; 294/88

[58] Field of Search ..... 61/69, 63, 110; 294/88; 285/24; 214/1 CM; 166/0.5; 254/1

[56] References Cited

U.S. PATENT DOCUMENTS

| | | | |
|---|---|---|---|
| 3,400,541 | 9/1968 | Lloyd et al. | 61/69 R |
| 3,645,103 | 2/1972 | Laffont | 61/95 |
| 3,717,000 | 2/1973 | Rothwell | 61/69 R |
| 3,720,066 | 3/1973 | Vilain | 61/95 |
| 4,028,903 | 6/1977 | Dietrich | 61/110 |
| 4,030,309 | 6/1977 | Mason | 61/69 R |

*Primary Examiner*—Jacob Shapiro

*Attorney, Agent, or Firm*—Larson, Taylor and Hinds

[57] ABSTRACT

Equipment for removing and refitting resilient packing in a cardan joint at the base of a platform or column mounted on the sea bed, the cardan joint connected a pipe in the sea bed with a pipe leading up the column, said packing comprising a stack of rubber rings and metallic washers disposed between end plates and capable of being deformed in torsion and said packing being compressed between an abutment on the end of a hollow shaft in the cardan joint and an abutment on the adjacent end of a pipe. The equipment, comprising a casing, a carriage movable along guides on the casing, and a fork-shaped gripper mounted on the carriage, is provided with hooks adapted to secure the casing to the cardan joint, and drive means operable to move the carriage so that the gripper embraces the packing when the casing is secured to the cardan joint, said gripper including power operated pinchers having jaws arranged to engage lugs on the end plates of the packing and operable to force the end plates towards one another to compress the packing and reduce the overall length of the packing.

13 Claims, 6 Drawing Figures

33
30
25
20
26
28
27
47
46
16
34
40
39
76
34
50
57
50
V
V
71
38
43
41
50
44
23
45
52
24

EQUIPMENT FOR REMOVING AND REFITTING RESILIENT PACKING IN A CARDAN JOINT

BACKGROUND OF THE INVENTION

The invention relates to improvements to equipment of the type for manipulating, that is to say for mounting and dismounting, devices such as packings, on the sea bed, particularly resilient packings to be provided at the base of platforms or articulated columns for oil installations, as described, in particular, in the Applicant's French Pat. No. 1,519,891.

Such platforms, particularly those used as loading columns, production columns or burn-off columns, comprise at the base, on the sea bed, a cardan joint to which there lead pipelines adapted to be connected to one or more conduits extending along the column, the pipelines and conduits being intended for the circulation of liquids (petroleum) or gas.

In particular, it appears to be an advantage to cause the fluids to pass, at the position of the junction, through the hollow shafts and bearings of the cardan head, but in order to make allowance for the slight relative angular displacements of the shafts, it is then necessary to provide, between the cardan and the pipelines or conduits leading thereto, deformable packings adapted to be stressed in torsion, these torsion packings comprising, in particular, a stack of rubber rings and metallic rings in accordance with the Applicant's French Pat. No. 2,251,237, which stack is introduced, in the precompressed state, between flanges or abutments respectively rigidly connected to the elements to be united, and is then relaxed in such a manner as to come to bear, while still being compressed, against said abutments.

SUMMARY OF THE INVENTION

The object of this invention is to provide equipment adapted to enable the operations of compression to be exerted on the packings of the above mentioned kind to be effected easily at the moment of mounting or dismounting.

In one aspect thereof the equipment of this invention comprises, inside a submersible assembly equipped with means to ensure easily, at will, its sinking to the bottom or its rising to the surface, a carriage adapted to permit, on being displaced towards the packing to be manipulated, it to be grasped by systems of manoeuvrable pincers in such a manner that they can ensure not only the grasping but also the axial compression of said packing.

Once the operation of axial compression has been effected, said carriage can therefore ensure, in the case of a packing which is already mounted, the loosening of its external surfaces and its extraction, just as it can, of course, under the same conditions of tightening of the pincers, effect the introduction and the placing in position of a fresh packing, with the minimum labour at the bottom.

The means for ensuring the submersion or the rise of the assembly comprise any appropriate ballast system, for example with a plurality of ballast-tanks into which water can be introduced or from which it can be blown out at will by means of compressed-air cylinders.

The actual weight of said assembly in the water can be compensated, for example, by floats of expanded foam or in any other manner.

Apart from these arrangements, the invention comprises certain other arrangements which are preferably used at the same time and which will be discussed more explicitly hereinafter.

It relates, more particularly, to a certain mode of application (that where it is applied to the means for manipulating the packings at the base of articulated columns on the sea bed), and certain modes of embodiment of said arrangements; and it relates, still more particularly and by way of novel industrial products, to the equipment of the type in question comprising the application of these same arrangements, as well as to the special elements adapted for their construction and the assemblies, particularly the articulated columns, cooperating with such equipment.

In any case, it can be well understood by means of the following additional description and the accompanying drawings, which addition and drawings are, of course, given above all by way of indication.

BRIEF DESCRIPTION OF THE DRAWING FIGURES

FIG. 1 of these drawings shows, in partial perspective, the cardan head to be provided in a cardan joint at the base of an articulated column for an oil installation, this joint comprising, at the junction with appropriate pipelines or conduits, resilient packings stressed in torsion, these packings being adapted to be mounted or dismounted by means of the equipment according to the invention.

Figure 3:
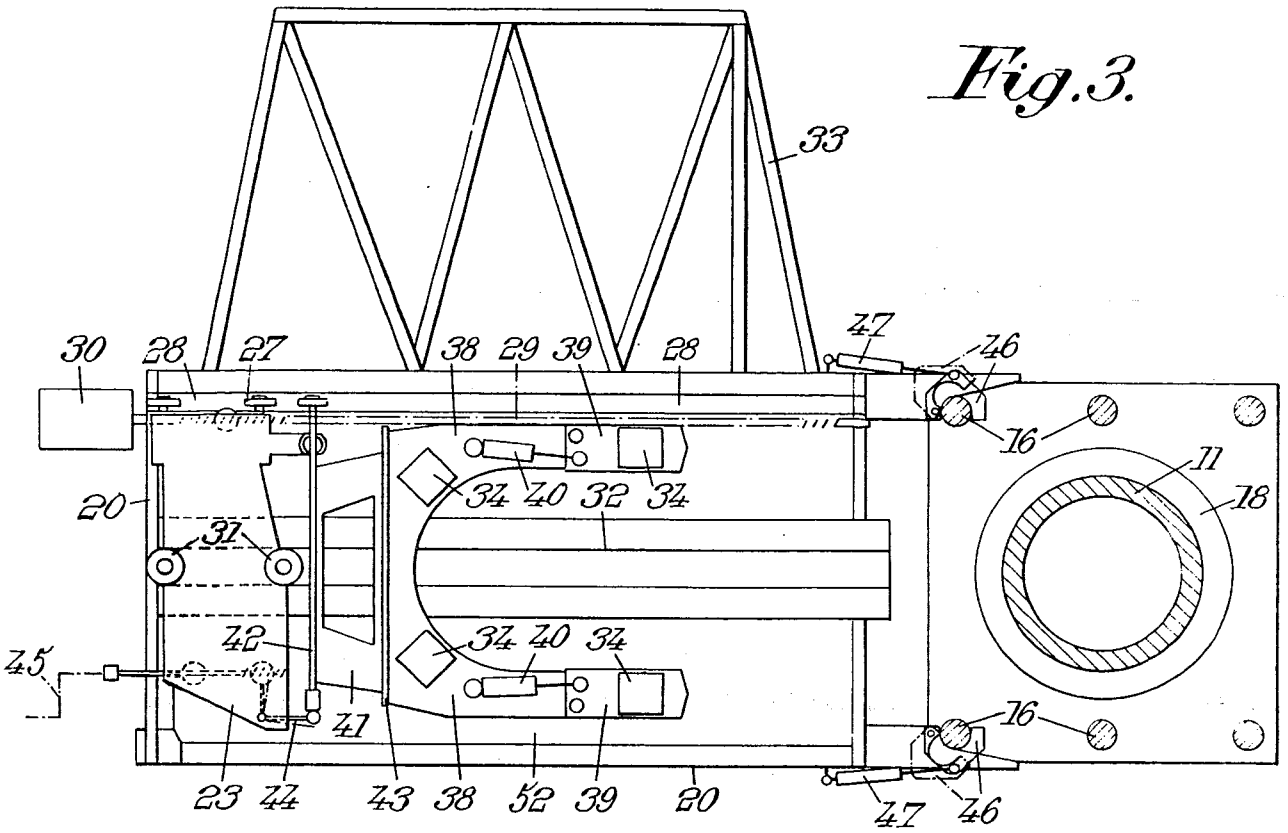
FIG. 3 shows, in diagrammatic elevation, with more detail, said equipment, the carriage of which is in the retracted position.
Figure 4:
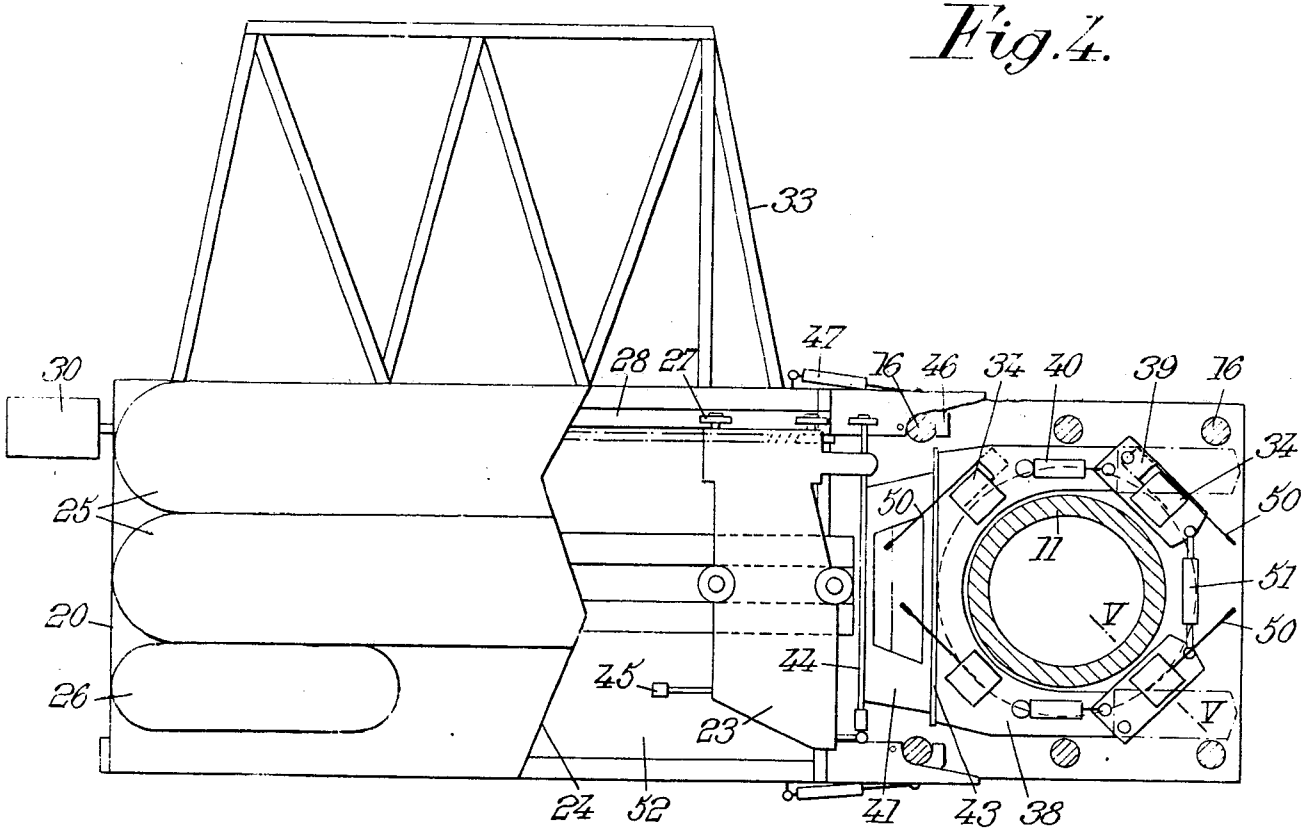
FIG. 4 shows, similarly, the same assembly, in the advanced and active position of its carriage.
Figure 6:
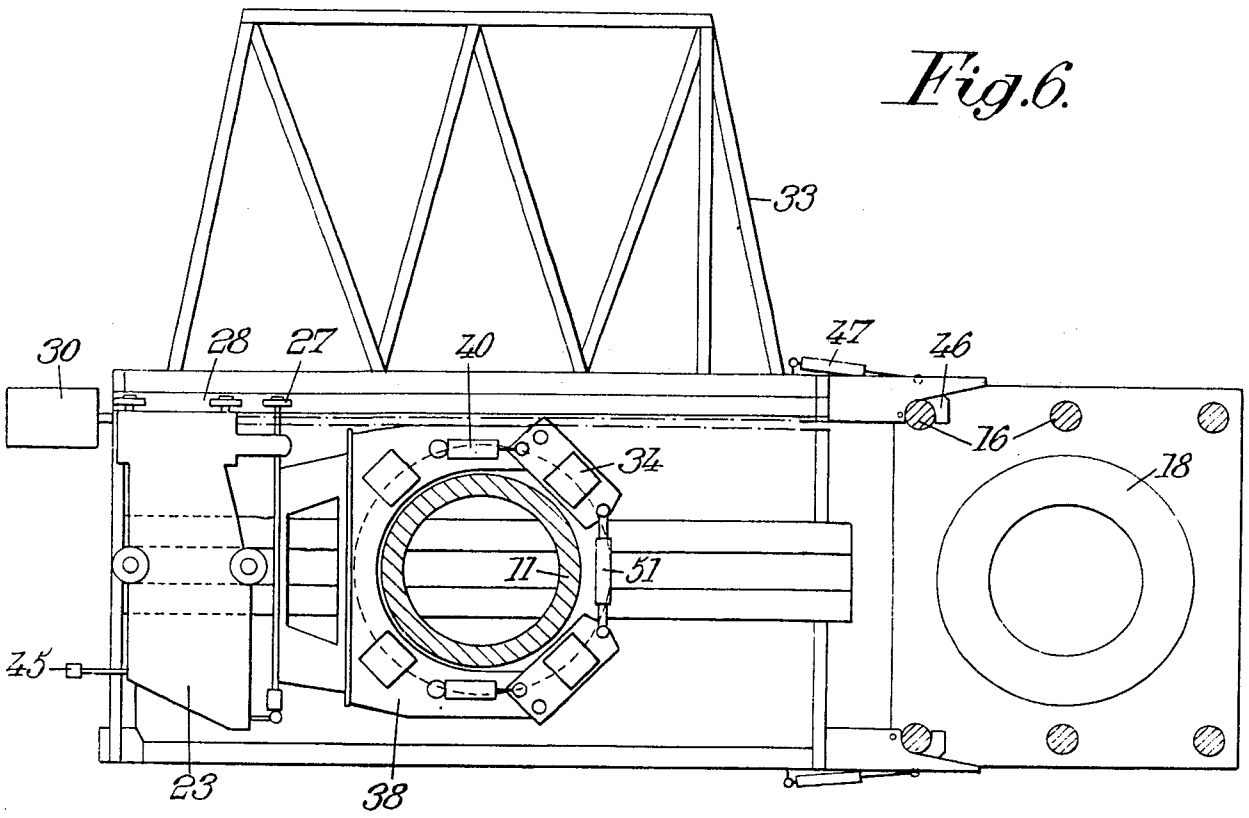

Finally, FIG. 6 shows, similarly to FIGS. 3 and 4, the equipment in the position for gripping a packing and in the return position of the carriage.

DETAILED DESCRIPTION OF THE ILLUSTRATED EMBODIMENTS

According to the invention, and more particularly according to that mode of application and according to those modes of embodiment of its various parts, to which it seems that preference should be given, when it is proposed, at a cardan joint at the base of an articulated column for an oil installation or the like, with resilient packings, to construct equipment for placing these packings in position or extracting them, the procedure is as follows or in a similar manner.

Figure 1:
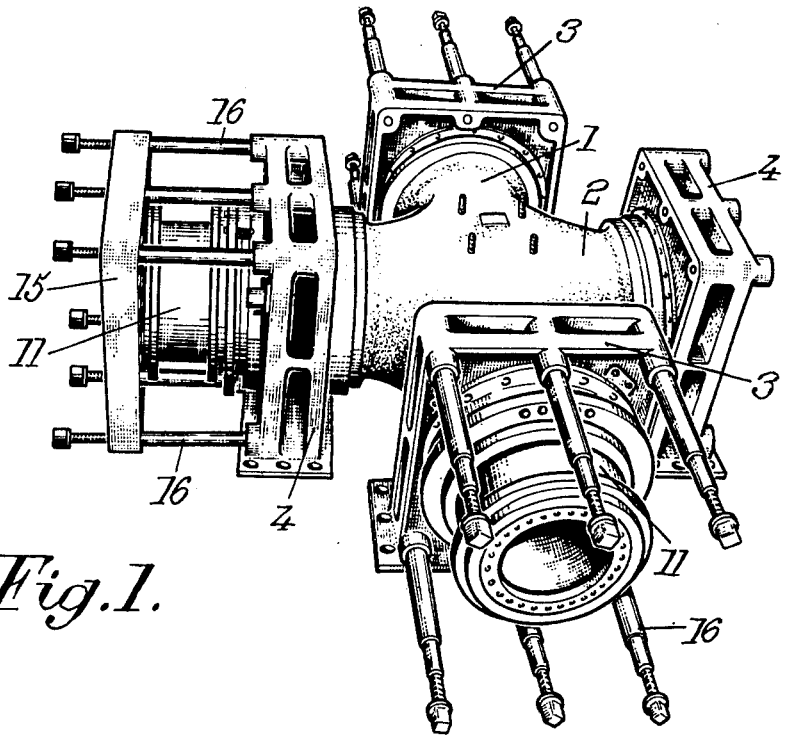

FIG. 1 illustrates, in perspective, a cardan head to be provided between a base fixed to the sea bed and the lower portion of the articulated column.

Figure 2:
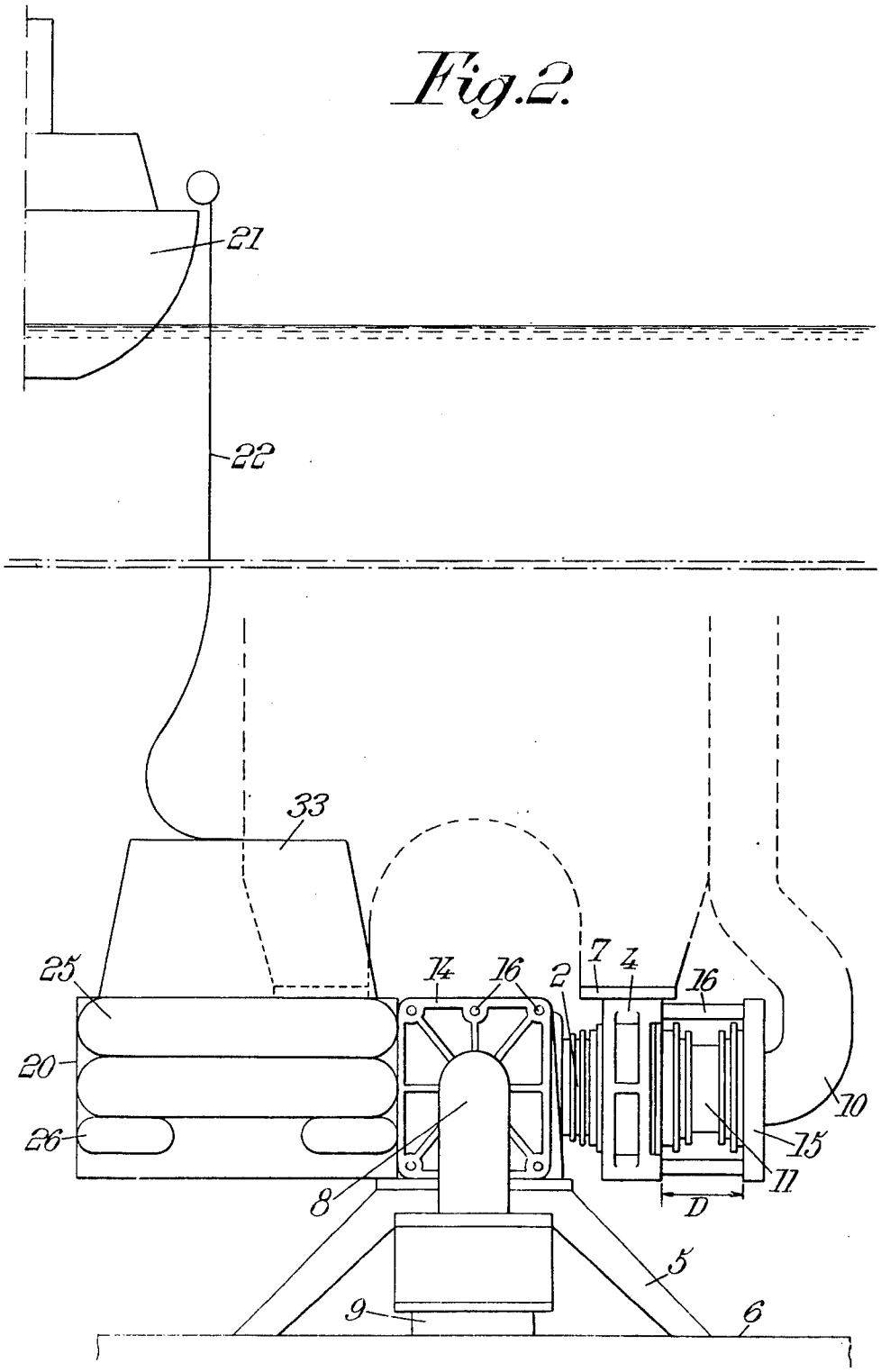
FIG. 2 shows, in partial elevation, the assembly of such a joint and an equipment according to the invention, assumed to be connected to a ship on the surface.

This cardan head, likewise visible in elevation in FIG. 2, comprises essentially two shafts or hollow cylindrical elements 1 and 2, disposed orthogonally and the ends of which are mounted for rotation in corresponding bearings, two of these bearings 3 being fixed, that is to say rigidly connected to the base 5 resting on the bottom 6 (FIG. 2), while the others 4 are movable, being rigidly connected to the base of the column 7.

The interior of the head is adapted to ensure the passage of the fluid (petroleum, gas) between, on the one hand, a fluid circuit comprising conduit branches 8 (FIG. 2) at the ends of a pipeline 9 in the ground, which conduits are connected to the hollow shafts 1 of said head, carried by the bearings 3 and, on the other hand, another circuit comprising conduits 10 extending along the column and adapted to be connected, at their base, to the hollow shafts 2 carried by the bearings 4.

Figure 5:
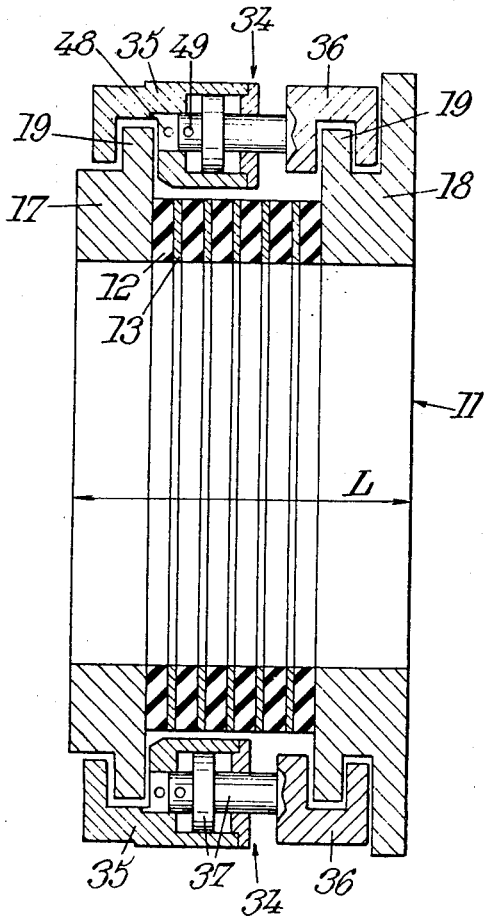
FIG. 5 is an enlarged section, through V—V FIG. 4, showing the gripping members with their jacks and, in section, the resilient packing before axial compression.

Because of the relative angular displacements of the bearings in relation to the hollow shafts 1, 2 of the cardan head, resilient packings are interposed between the ends of said shafts and the corresponding ends of the conduits cooperating therewith, which resilient packings are visible at 11 in FIGS. 1 and 2 and consist, for example, as shown in FIG. 5, of a stack of rubber rings 12 and metallic washers 13, such packings being able to be deformed in torsion about their central axis.

The assembly is mounted in such a manner that the resilient packings in question are subjected, during mounting, to an axial compressive stress in such a manner that their axial length L (FIG. 5), initially greater than the distance D (FIG. 2) between the abutment elements against which they have to bear, is momentarily brought, by pressure means, to a length shorter than D, to permit their introduction between said elements, after which the pressure means are released so that the packings come to bear, while remaining compressed, against said abutment elements.

At the side where the conduits 8, 10 are, the abutment will take place, for example, on thrust plates such as 14, 15 at which the ends of the conduits 8, 10 end. These plates are rigidly connected to the corresponding bearings by means of struts such as 16, with an adjustable spacing with respect to said bearings, these struts being intended to ensure the connection and to receive the prestressing of the packings.

Said packings are preferably equipped, at their ends, with thrust rings 17, 18, the outside profile of which is preferably selected in such a manner that it enables the gripping by the pressing means, and hence, likewise, the axial tightening, to be effected easily, this profile comprising, for example, circular ribs such as 19 (FIG. 5), the purpose of which will be apparent hereinafter.

In combination with such an assembly or with any other comparable thereto, an equipment is produced adapted to enable said packings to be manipulated easily, on the bottom, both for their mounting and for their dismounting, said tools comprising, for this purpose, gripping means adapted to exert on the packings, when desired, the axial compression required, both to permit their separation from the surfaces of the cardan or of the abutments 14, 15, and, similarly, to permit the maximum compression during mounting.

This equipment comprises essentially, for example, a hollow chassis 20, equipped with means adapted to enable its descent and its return to the surface to be effected easily, by ballasting it or unballasting it, from the boat 21 (FIG. 2), through a cable 22 or in any other manner, this chassis carrying a carriage 23 (FIG. 3) equipped with means to permit both the gripping of a packing 11 to be effected and the operations of axial tightening and releasing of this to be effected.

The assembly may be completed by a structure 33 adapted to contain, for example, expanded foam intended to compensate for the dead weight of said assembly in the water, this foam having a volume of from 5 to $10m^3$, for example.

The chassis 20 has the shape of a parallelepiped box, for example, divided into a plurality of lateral compartments (of which one 24 is visible broken away in FIG. 4), adapted to contain ballast cylinders 25, in combination with compressed-air reservoirs 26, with remote-controlled valves, and, on the other hand, a central compartment 52 (FIGS. 3 and 4) containing the carriage 23 equipped with wheels or rollers 27 adapted to be displaced on a rolling track 28. This carriage, in the application under consideration where the axis of the packings appears in a substantially horizontal direction, on mounting, may advantageously be disposed vertically to ensure a correct position for its gripping means. In order to ensure its displacement, it is equipped with drive means comprising, for example, at least one threaded rod 29 driven by a motor 30. A central guiding may be provided at 31, 32.

Now, so far as the gripping means to be carried by said carriage 20 are concerned, they are made to comprise, for example, a certain number of pincers 34 (FIGS. 3 to 6) adapted to surround the packing to be manipulated, to hook onto this, particularly onto the ribs 19 mentioned above.

These pincers may be four in number, for example, adapted to surround said packing in the operational position, as can be seen in FIGS. 4 and 6, being at 90° to one another.

They are adapted, for example, in the manner illustrated in FIG. 5, that is to say consisting of two segments 35, 36, provided with grooves intended to ensure the hooking on the ribs 19, the segments of each pair being connected to one another by a remote-controlled jack 37, enabling them to be brought closer together or moved apart parallel to the axis of the packing.

Furthermore, means are combined with these pincers to enable the packing to be locked in its position of maximum compression corresponding to mounting. These means may consist, most simply, of holes 48, 49 formed in two parts in relative movement. When the above-mentioned position is reached, these holes are opposite one another so that the locking is obtained by causing locking rods 50 (FIG. 4) to pass through these holes, any other means being able to be provided for the same purpose.

The four pincers 34 are mounted on a support connected to the carriage 23 and adapted in such a manner as to be able to be introduced easily into the space remaining available at the entrance to the gap defined by the thrust elements such as 3 and 14 or 4 and 15 (FIG. 1), passing between the struts 16 (some of which may be released if necessary).

This support, visible at 38 in FIGS. 3, 4 and 6, and made in extension of the carriage 23, has the shape of a fork, for example, two pivoting arms 39 which carry two of the pincers 34, while the other pincers 34 are carried by the hollow of the fork, the two pivoting arms 39 being controlled by jacks 40. In the position of the pincers for final placing in position, tightening means are provided to maintain this position, for example a screw device or a spring device 51 hooked between the two arms 39.

Apart from this, said support is connected to the actual carriage 23 by means preferably adapted in such a manner that they enable certain possibilities of adjustment in its orientation to be ensured for this support.

Thus these means may comprise a pivoting connection between support 38 and carriage 23, realized by means of an intermediate element 41 articulated on the support and on the carriage about substantially parallel pins 42, 43. This enables the support 38 to execute slight displacements parallel to itself, which displacements may be remote-controlled or be obtained directly by divers at the moment of the mounting or dismounting operation.

In addition, said means may comprise a possibility for angular displacements of the support 38 in its plane, for example through a bell-crank lever 44 controlled from a crank-handle 45, this lever enabling the orientation of the pin 42 to be varied.

Finally, the assembly is completed by means adapted to enable the apparatus to be fixed to the cardan structure, for example to the struts 16, during the mounting or dismounting operations. These means comprise, in particular, hooks 46, formed at the head of said assembly and controlled by jacks 47.

Likewise provided in this same assembly, of course, is an energy source comprising, for example, a hydraulic system with an immersed motor-pump centre, feeding the jacks of the pincers, the positioning jacks for the pincers, the hydraulic motor for the advance of the carriage and the jacks for hooking onto the struts.

Under the effect of this equipment, the four pincers for tightening the packing should be capable of delivering a total compressive force of 200 t with a pressure of 500 bars and rates of stress lower than 60% of the elastic limit.

As a result of which, an equipment is produced, the operation of which is as follows.

If it is a question of dismounting packings already in existence, for example, the apparatus is caused to descend, by a cable 22 (FIG. 1), the apparatus being given, during this descent, by adjustment of the ballast, a low apparent weight, for example 150 kg.

Once it has reached the bottom (FIG. 3), the apparatus is further unballasted, down to an apparent weight of zero, to facilitate the manipulation.

Everything is then ready to allow the divers, first to grip the apparatus to the struts 16 by manipulating hooks 46 by means of the jacks 47, then to control the displacement of the carriage via the motor, guiding the support 38 carrying the pincers appropriately for the latter to be positioned correctly, first for the two of them disposed at the bottom of the fork, then for the other two, after the two pivoting arms 39 have been lowered by means of the jacks 40, the placing in position of the tightening means 51 (FIG. 4) terminating the operation.

When this position has been reached, the jacks 37 are caused to act for the maximum compression of the packing, and the bolts 50 are placed in position in the facing holes 48, 49 to maintain this compression.

From this moment on, the packing is released from its abutment faces and it can be extracted by restoring the carriage to the rear (after having released the hooks 46), as illustrated in FIG. 6.

It only remains to unballast the apparatus to cause it to rise to the surface.

The same operations have to be carried out in reverse for mounting a packing.

In the above, it is assumed that the fixing of the end rings 17 and 18 of the packing against the corresponding abutments, carried respectively by the parts to be connected, was obtained under the effect of the compression of the rubber, by adhesion. But, of course, additional fixing by bolts or the like is possible, in which case this fixing should be released in the course of the manipulation for the extraction or placing in position of the packings.

In any case, the invention enables an apparatus to be created which is adapted to effect the extraction or the placing in position of the packings in very short times, by simple means which only require the minimum work on the part of the divers.

As goes without saying and as follows, moreover, from what precedes, the invention is in no way limited to those of its modes of application and of embodiment which have been envisaged; on the contrary, it includes all the variants.

I claim:

1. Equipment for removing and replacing a resilient packing compressed between two abutments under water, particularly resilient packings on articulated columns on the seabed, said equipment comprising a submersible assembly including a frame, means on said frame for adjusting the buoyancy of the assembly, a carriage moving on said frame, and a plurality of pincers mounted on said carriage, said pincers being engageable with the packing and operable for bringing it temporarily to dimension change smaller than the working distance between said abutments, said assembly being positionable in front of the packing, the carriage being movable between a retracted position on said frame and a position adjacent the location of the packing allowing engagement of said pincers with said packing between said two abutments for withdrawing said packing from or replacing it between said abutments, said submersible assembly comprising a tank having a compartment accommodating said carriage, and said carriage including a fork arranged with one arm thereof vertically above the other arm, said pincers being mounted on the arms of the fork.

2. Equipment as claimed in claim 1, characterised in that said tank is subdivided into a central compartment and lateral compartments, the carriage together with the pincers being disposed in said central compartment, and said buoyancy means being disposed in said lateral compartments, the buoyancy means including floats or ballasts, with compressed-air cylinders to obtain the ballasting or unballasting at will.

3. Equipment as claimed in claim 1, characterised in that the assembly further comprises a device compensating for the weight of the equipment to enable the apparent weight in the water to be reduced, for example a volume of expanded foam.

4. Equipment as claimed in claim 1, characterised in that four pairs of pincers are provided, two of them being mounted at the base of said fork and the other two being carried by pivoting arms, mounted at the ends of the fork and manoeuvrable by jacks.

5. Equipment as claimed in claim 4, characterised in that there are also provided, in combination with the pincers, locking means adapted to hold them in the final position of axial tightening, once this position has been reached.

6. Equipment as claimed in claim 1, characterised in that the ends of said fork are equipped with hooks adapted to attach said equipment to the assembly comprising the packings.

7. Equipment as claimed in claim 6, for use with packings adapted to bear against two abutment elements connected to one another by struts, characterised in that said hooks are arranged to engage certain of said struts, being controlled by a jack.

8. Equipment as claimed in claim 1, characterised in that said pincers are mounted on a support on said carriage, and means are provided to permit adjustment of the position of said support in relation to the carriage.

9. Equipment as claimed in claim 8, characterised in that said means permit slight displacements of said support, parallel to itself.

10. Equipment as claimed in claim 8, characterised in that said means permit slight angular displacements of said support in its plane.

11. Equipment as claimed in claim 1, including a screw system for displacing said carriage.

12. Equipment for removing and replacing a resilient packing compressed between two abutments under water, particularly resilient packings on articulated columns on the sea bed and having end rings provided with projecting elements, said equipment comprising a submersible assembly including a frame, means on said frame for adjusting the buoyancy of the assembly, a carriage moving on said frame, and a plurality of pincers mounted on said carriage, said pincers being engageable with the packing and operable for bringing it temporarily to dimension change smaller than the working distance between said abutments, said assembly being positionable in front of the packing, the carriage being movable between a retracted position on said frame and a position adjacent the location of the packing allowing engagement of said pincers with said packing between said two abutments for withdrawing said packing from or replacing it between said abutments, said pincers each comprising two members adapted to grip projecting elements of the end rings, and a jack interconnecting said members and operable to move said members closer together to compress the packing axially or to move said members further apart.

13. Equipment as claimed in claim 2, characterised in that said members of each pincer are provided with holes adapted to come into coincidence in the final position of axial tightening and to be held in this position by the introduction of a bolt into said holes.

* * * * *